US008021996B2

(12) United States Patent
Walser et al.

(10) Patent No.: US 8,021,996 B2
(45) Date of Patent: Sep. 20, 2011

(54) NONWOVEN WEB AND FILTER MEDIA CONTAINING PARTIALLY SPLIT MULTICOMPONENT FIBERS

(75) Inventors: Susan Kathleen Walser, Alpharetta, GA (US); Leon Eugene Chambers, Jr., Cumming, GA (US); Reginald Smith, Roswell, GA (US); Nancy J. Zimmerman, Alpharetta, GA (US); Kiran K. Reddy, Alpharetta, GA (US); Nina Frazier, Mableton, GA (US); David Myers, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/343,003

(22) Filed: Dec. 23, 2008

(65) Prior Publication Data

US 2010/0159770 A1 Jun. 24, 2010

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |

(52) U.S. Cl. ..... 442/361; 442/334; 442/335; 442/337; 442/340; 442/362; 442/381; 442/384; 442/401; 442/408

(58) Field of Classification Search ..... 442/361, 442/362, 340, 381, 384, 401, 408, 334, 335, 442/337

See application file for complete search history.

(56) References Cited

U.S. PATENT DOCUMENTS

| | | | |
|---|---|---|---|
| 2,666,369 | A | 1/1954 | Niks |
| 3,338,992 | A | 8/1967 | Kinney |
| 3,341,394 | A | 9/1967 | Kinney |
| 3,423,266 | A | 1/1969 | Davies et al. |
| 3,485,706 | A | 12/1969 | Evans |
| 3,502,763 | A | 3/1970 | Hartmann |
| 3,542,615 | A | 11/1970 | Dobo |
| 3,692,618 | A | 9/1972 | Dorschner et al. |
| 3,802,817 | A | 4/1974 | Matsuki et al. |
| 3,821,068 | A | 6/1974 | Shaw |
| 4,340,563 | A | 7/1982 | Appel et al. |
| 4,375,718 | A | 3/1983 | Wadsworth et al. |

(Continued)

FOREIGN PATENT DOCUMENTS

| | | | |
|---|---|---|---|
| EP | 0 473 325 | A1 | 3/1992 |

(Continued)

OTHER PUBLICATIONS

Patent Cooperation Treaty Search Report from the International Search Authority, International Application No. PCT/IB2009/055302 dated Jul. 27, 2010.

*Primary Examiner* — Norca L Torres Velazquez
(74) *Attorney, Agent, or Firm* — Ralph H. Dean, Jr.

(57) ABSTRACT

The present invention provides a nonwoven web prepared from multicomponent fibers which are partially split. The partially split multicomponent fibers have at least one component of the multicomponent fiber separated from the remaining components of the multicomponent fiber along a first section of the longitudinal length of the multicomponent fibers. Along a second section of the longitudinal length of the multicomponent fibers the components of the multicomponent fibers remain together as a unitary fiber structure. In addition, part of the second section of the multicomponent fibers is bonded to part of a second section of an adjacent multicomponent fiber.

37 Claims, 7 Drawing Sheets

U.S. PATENT DOCUMENTS

| | | | |
|---|---|---|---|
| 4,536,440 | A | 8/1985 | Berg |
| 4,547,420 | A | 10/1985 | Krueger et al. |
| 4,592,815 | A | 6/1986 | Nakao |
| 4,874,659 | A | 10/1989 | Ando et al. |
| 4,939,016 | A | 7/1990 | Radwanski et al. |
| 5,023,130 | A | 6/1991 | Simpson et al. |
| 5,108,820 | A | 4/1992 | Kaneko et al. |
| 5,108,827 | A | 4/1992 | Gessner |
| 5,151,320 | A | 9/1992 | Homonoff et al. |
| 5,246,474 | A | 9/1993 | Greatorex |
| 5,254,399 | A | 10/1993 | Oku et al. |
| 5,290,628 | A | 3/1994 | Lim et al. |
| 5,294,482 | A | 3/1994 | Gessner |
| 5,334,446 | A | 8/1994 | Quantrille et al. |
| 5,336,552 | A | 8/1994 | Strack et al. |
| 5,355,565 | A | 10/1994 | Baravian |
| 5,382,400 | A | 1/1995 | Pike et al. |
| 5,401,446 | A | 3/1995 | Tsai et al. |
| 5,486,411 | A | 1/1996 | Hassenboehler, Jr. et al. |
| 5,487,943 | A | 1/1996 | Kozulla |
| 5,496,507 | A | 3/1996 | Angadjivand et al. |
| 5,607,766 | A | 3/1997 | Berger |
| 5,633,082 | A | 5/1997 | Berger |
| 5,707,468 | A | 1/1998 | Arnold et al. |
| 5,718,972 | A | 2/1998 | Murase et al. |
| 5,759,926 | A | 6/1998 | Pike et al. |
| 5,855,788 | A | 1/1999 | Everhart et al. |
| 5,871,836 | A | 2/1999 | Schultink et al. |
| 5,898,981 | A | 5/1999 | Legare |
| 5,935,883 | A | 8/1999 | Pike |
| 5,955,174 | A | 9/1999 | Wadsworth et al. |
| 6,057,256 | A | 5/2000 | Krueger et al. |
| 6,103,181 | A | 8/2000 | Berger |
| 6,162,535 | A | 12/2000 | Turkevich et al. |
| 6,171,369 | B1 | 1/2001 | Schultink et al. |
| 6,200,669 | B1 | 3/2001 | Marmon et al. |
| 6,211,100 | B1 | 4/2001 | Legare |
| 6,321,425 | B1 | 11/2001 | Putnam et al. |
| 6,365,088 | B1 | 4/2002 | Knight et al. |
| 6,391,200 | B2 | 5/2002 | Pulek et al. |
| 6,419,729 | B1 | 7/2002 | Duffy et al. |
| 6,444,312 | B1 | 9/2002 | Dugan |
| 6,461,729 | B1 | 10/2002 | Dugan |
| 6,465,095 | B1 | 10/2002 | Dugan |
| 6,573,205 | B1 | 6/2003 | Myers et al. |
| 6,613,704 | B1 | 9/2003 | Arnold et al. |
| 6,624,100 | B1 | 9/2003 | Pike |
| 6,627,025 | B1 | 9/2003 | Yu |
| 6,649,547 | B1 | 11/2003 | Arnold et al. |
| 6,692,541 | B2 | 2/2004 | Carlson et al. |
| 6,695,941 | B2 | 2/2004 | Hartgrove et al. |
| 6,750,161 | B2 | 6/2004 | Putnam et al. |
| 6,759,356 | B1 | 7/2004 | Myers |
| 6,767,498 | B1 | 7/2004 | Talley, Jr. et al. |
| 6,770,356 | B2 | 8/2004 | O'Donnell et al. |
| 6,776,858 | B2 | 8/2004 | Bansal et al. |
| 6,780,357 | B2 | 8/2004 | Dugan et al. |
| 6,782,589 | B2 | 8/2004 | Ngai |
| 6,815,383 | B1 | 11/2004 | Arnold |
| 6,838,402 | B2 | 1/2005 | Harris et al. |
| 6,877,196 | B2 | 4/2005 | Oathout et al. |
| 6,893,990 | B2 | 5/2005 | Myers et al. |
| 6,903,034 | B1 | 6/2005 | Putnam et al. |
| 6,905,987 | B2 | 6/2005 | Noda et al. |
| 6,942,711 | B2 | 9/2005 | Faulkner et al. |
| 7,244,291 | B2 | 7/2007 | Spartz et al. |
| 7,244,292 | B2 | 7/2007 | Kirk et al. |
| 2001/0014393 | A1* | 8/2001 | Groten et al. ..... 428/361 |
| 2001/0038901 | A1 | 11/2001 | Morishima et al. |
| 2002/0013111 | A1 | 1/2002 | Dugan et al. |
| 2002/0025753 | A1 | 2/2002 | Putnam |
| 2003/0021970 | A1 | 1/2003 | Noelle |
| 2003/0084788 | A1 | 5/2003 | Fraser |
| 2003/0118776 | A1 | 6/2003 | Anderson et al. |
| 2003/0118816 | A1* | 6/2003 | Polanco et al. ..... 428/369 |
| 2003/0166370 | A1 | 9/2003 | Harris et al. |
| 2003/0203695 | A1 | 10/2003 | Polanco et al. |
| 2004/0010894 | A1 | 1/2004 | Goldwasser et al. |
| 2004/0128807 | A1 | 7/2004 | Qashou |
| 2004/0161994 | A1 | 8/2004 | Arora et al. |
| 2004/0242108 | A1 | 12/2004 | Russell et al. |
| 2005/0000890 | A1 | 1/2005 | Pearce |
| 2005/0020159 | A1 | 1/2005 | Zucker |
| 2005/0039836 | A1 | 2/2005 | Dugan et al. |
| 2005/0092417 | A1 | 5/2005 | Billgren et al. |
| 2005/0098256 | A1 | 5/2005 | Polanco et al. |
| 2005/0159065 | A1 | 7/2005 | Stralin et al. |
| 2005/0176326 | A1 | 8/2005 | Bond et al. |
| 2005/0202744 | A1 | 9/2005 | Putnam et al. |
| 2005/0208858 | A1 | 9/2005 | Dillinger |
| 2005/0215156 | A1 | 9/2005 | Ferencz et al. |
| 2005/0215157 | A1 | 9/2005 | Dugan et al. |
| 2005/0227566 | A1 | 10/2005 | Bergquist et al. |
| 2005/0278912 | A1 | 12/2005 | Westland et al. |
| 2006/0021302 | A1 | 2/2006 | Bernard |
| 2006/0035555 | A1 | 2/2006 | Narayanan et al. |
| 2006/0063456 | A1 | 3/2006 | Carter |
| 2006/0068673 | A1 | 3/2006 | Goene |
| 2006/0111004 | A1 | 5/2006 | Pearce et al. |
| 2006/0137155 | A1 | 6/2006 | Louis Dit Picard et al. |
| 2006/0147804 | A1 | 7/2006 | Yamamoto et al. |
| 2006/0185134 | A1 | 8/2006 | Carter et al. |
| 2006/0191115 | A1 | 8/2006 | Carter et al. |
| 2006/0211323 | A1 | 9/2006 | Benim et al. |
| 2006/0243138 | A1 | 11/2006 | Spartz et al. |
| 2006/0243139 | A1 | 11/2006 | Kirk et al. |
| 2007/0178795 | A1 | 8/2007 | Stralin et al. |
| 2007/0232174 | A1 | 10/2007 | Karandlkar et al. |

FOREIGN PATENT DOCUMENTS

| | | | |
|---|---|---|---|
| EP | 0 620 294 | B1 | 1/1999 |
| EP | 1 554 028 | B1 | 3/2006 |
| GB | 2 394 232 | A | 4/2004 |
| WO | WO 99/19131 | A1 | 4/1999 |
| WO | WO 99/22059 | A1 | 5/1999 |
| WO | WO 01/59194 | A1 | 8/2001 |
| WO | WO 2006/096486 | A2 | 9/2006 |
| WO | WO 2006/115831 | A1 | 11/2006 |

* cited by examiner

NONWOVEN WEB AND FILTER MEDIA CONTAINING PARTIALLY SPLIT MULTICOMPONENT FIBERS

FIELD OF THE INVENTION

The present invention generally relates to a nonwoven web material prepared from multicomponent fibers which are partially split. The present invention also generally relates to a filter media prepared from the nonwoven web.

BACKGROUND OF THE INVENTION

Nonwoven webs have been used to make a variety of products, which desirably have particular levels of softness, strength, uniformity, liquid handling properties such as absorbency, and other physical properties. Such products include towels, industrial wipes, adult incontinence products, infant care products such as baby diapers, absorbent feminine care products, and garments such as medical apparel, just to name a few products. Nonwoven webs may make up one or more layers in these products. Nonwoven webs have also been used in other applications including as a filter media typically used as fluid filters such as air filters. Nonwoven webs have also been used as sound absorbing materials which are used in vehicles, appliances, homes, and the like.

In the field of filtration, it is desirable to have a filter media which has both high filter efficiency and high fluid (air or liquid) throughput. That is, the filter media must have the ability to prevent fine particles from passing through the filter media while having a low fluid flow resistance. Typically, filter media prevents fine particles from passing through the filter media by mechanically trapping the particles within the fibrous structure of the filter media. In addition, some filter media, in the case of air filtration media, is also electrostatically charged which allows the filter media to electrostatically attract and capture fine particles. Flow resistance is measured in terms of pressure drop or pressure differential across the filter material. A high pressure drop indicates a high resistance to the fluid flow through the filter media, while a low pressure drop indicates a low fluid flow resistance. In addition, the filter media must also exhibit a useful service life which is not too short as to require frequent cleaning or replacement of the filter containing the filter media.

However, these performance requirements for filter media are generally inversely correlated. There is a balance between filter media efficiency, pressure drop across the filter media, and useful life of a filter media. Generally, as is known in the filter media art, increasing the particle capture efficiency by increasing the surface area of the filtration media increases the pressure drop across the filtration media and/or the reduces the useful life of the filter media. It is also pointed out that a high pressure drop across the filter media increases the energy cost to operate the systems using the filters. This is because the pumps or fans designed to move the fluid through the filter media must be run at a higher speed or pressure to achieve the same desired fluid flow when the pressure drop is large.

There is a need in the art for a filtration media which has high filtration efficiency, low pressure drop across the filtration media and a long service life.

SUMMARY OF THE INVENTION

Generally stated, the present invention provides a nonwoven web formed from multicomponent fibers. The multicomponent fibers have a longitudinal length and each multicomponent fiber has at least a first component and at least a second component. One of the components of the multicomponent fibers has a lower melting point or glass transition temperature than other components. A portion of the multicomponent fibers are partially split. A partially split multicomponent fiber is a fiber in which at least one component of the multicomponent fiber has separated from the remaining components of the multicomponent fiber along a first section of the longitudinal length of the multicomponent fibers, and along a second section of the longitudinal length of the multicomponent fibers the components of the multicomponent fibers remain together as a unitary fiber structure. In addition, part of the second section of the multicomponent fibers is fused to part of a second section of an adjacent multicomponent fiber.

In another embodiment of the present invention, the present invention provides a filter media prepared from a nonwoven web formed from multicomponent fibers. The multicomponent fibers have a longitudinal length and each multicomponent fiber has at least a first component and at least a second component. One of the components of the multicomponent fibers has a lower melting point or glass transition temperature than other components. A portion of the multicomponent fibers are partially split. A partially split multicomponent fiber is a fiber in which at least one component of the multicomponent fiber has separated from the remaining components of the multicomponent fiber along a first section of the longitudinal length of the multicomponent fibers, and along a second section of the longitudinal length of the multicomponent fibers the components of the multicomponent fibers remain together as a unitary fiber structure. In addition, part of the second section of the multicomponent fibers is fused to part of a second section of an adjacent multicomponent fiber.

Also provided by the present invention is a method of preparing the nonwoven web and the filter media. The method includes forming a nonwoven web comprising multicomponent fibers; thermally bonding the nonwoven web to form a bonded nonwoven web; and hydroentangling the bonded nonwoven web at a pressure between about 500 and 3000 psi.

Other embodiments of the present invention include preparing a laminate of the nonwoven web of the present invention with an additional layer of another nonwoven web. The additional layer laminated to the nonwoven web of the present invention include spunbond nonwoven webs, meltblown nonwoven webs, bonded carded webs, coform nonwoven webs, and/or hydroentangled nonwoven webs. One or more of these additional nonwoven layers may be laminate to the nonwoven layer containing the partially split multicomponent fibers.

By providing the nonwoven web of the present invention, and using the nonwoven web as a filter media, it has been discovered that the filter media surprisingly has a high filtration efficiency and a lower pressure drop as compared to filter media without the partially split multicomponent fibers.

DEFINITIONS

Figure 1:
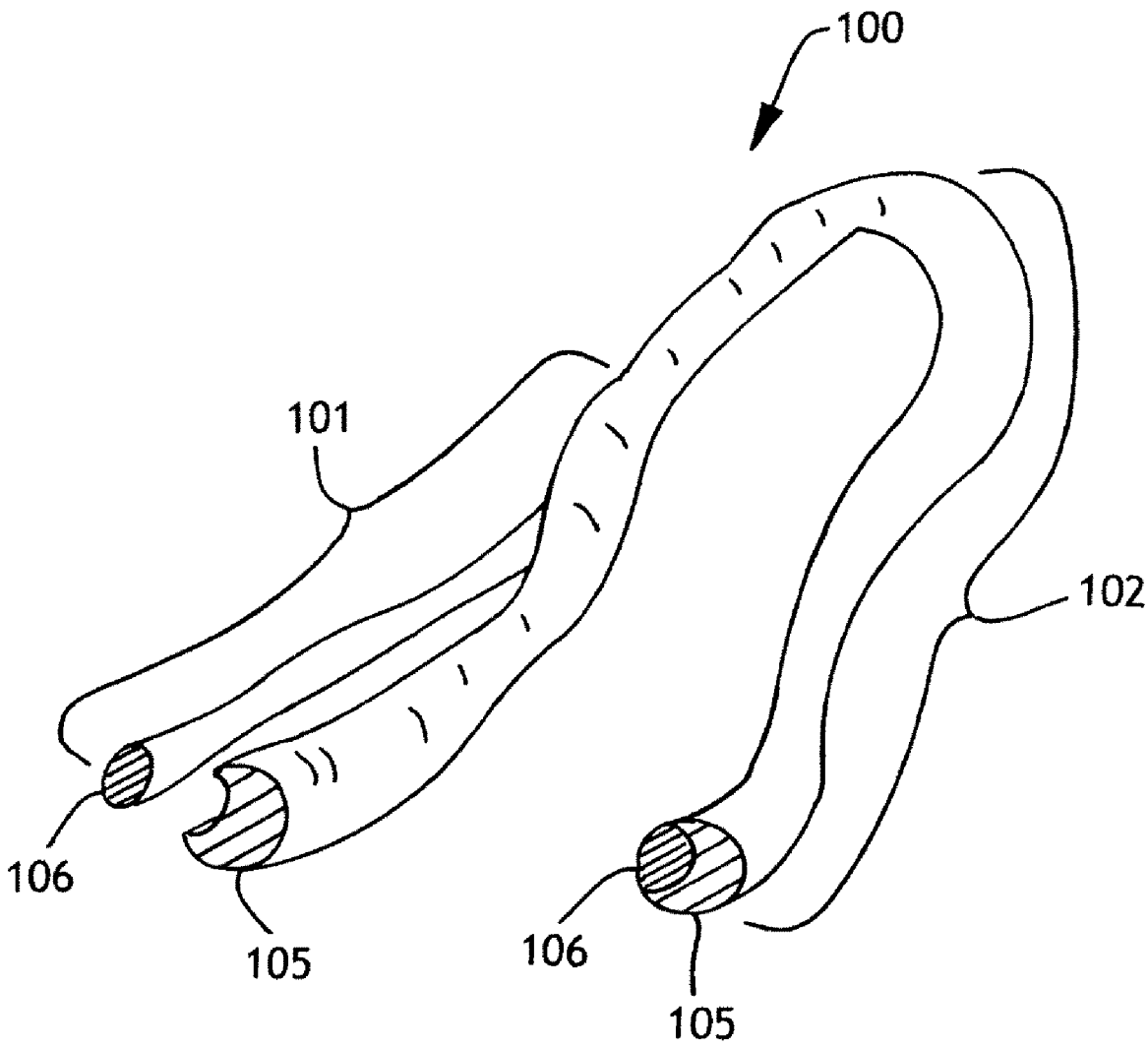
FIG. 1 shows a line drawing of a partially split multicomponent fiber present in a nonwoven web of the present invention.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, the term "nonwoven web" means a web having a structure of individual fibers or threads which are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters are usually expressed in microns, or in the case of staple fibers, denier. It is noted that to convert from osy to gsm, multiply osy by 33.91.

As used herein, the terms "filter media" or "filtration media" are used interchangeable herein and are intended to mean a material which is used in fluid filtration to remove particles from the fluid. The fluid which is filtered with the filter media includes gas phase fluids, liquid phase fluids and fluids having both gas and liquid phases.

As used herein the term "spunbond fibers" refers to small diameter fibers of molecularly oriented polymeric material. Spunbond fibers may be formed by extruding molten thermoplastic material as fibers from a plurality of fine, usually circular capillaries of a spinneret with the diameter of the extruded fibers then being rapidly reduced as in, for example, U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. Spunbond fibers are generally not tacky when they are deposited onto a collecting surface and are generally continuous. Spunbond fibers are often about 10 microns or greater in diameter. However, fine fiber spunbond webs (having an average fiber diameter less than about 10 microns) may be achieved by various methods including, but not limited to, those described in commonly assigned U.S. Pat. No. 6,200,669 to Marmon et al. and U.S. Pat. No. 5,759,926 to Pike et al., each is hereby incorporated by reference in its entirety.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "multicomponent fibers" refers to fibers or filaments which have been formed from at least two polymers extruded from separate extruders but spun together to form one fiber. Multicomponent fibers are also sometimes referred to as "conjugate" or "bicomponent" fibers or filaments. The term "bicomponent" means that there are two polymeric components making up the fibers. The polymers are usually different from each other, although conjugate fibers may be prepared from the same polymer, if the polymer in each component is different from one another in some physical property, such as, for example, melting point, glass transition temperature or the softening point. In all cases, the polymers are arranged in substantially constantly positioned distinct zones across the cross-section of the multicomponent fibers or filaments and extend continuously along the length of the multicomponent fibers or filaments. The configuration of such a multicomponent fiber may be, for example, a sheath/core arrangement, wherein one polymer is surrounded by another, a side-by-side arrangement, a pie arrangement or an "islands-in-the-sea" arrangement. Multicomponent fibers are taught in U.S. Pat. No. 5,108,820 to Kaneko et al.; U.S. Pat. No. 5,336,552 to Strack et al.; and U.S. Pat. No. 5,382,400 to Pike et al.; the entire content of each is incorporated herein by reference. For two component fibers or filaments, the polymers may be present in ratios of 75/25, 50/50, 25/75 or any other desired ratios.

As used herein, the term "multiconstituent fibers" refers to fibers which have been formed from at least two polymers extruded from the same extruder as a blend or mixture. Multiconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Fibers of this general type are discussed in, for example, U.S. Pat. Nos. 5,108,827 and 5,294,482 to Gessner.

As used herein, the term "partially split" when referring to the multicomponent fibers, means that an individual fiber has a region along the length of the fiber in which the individual components of the multicomponent fibers are separated from one another. In addition, at a second region along the length of the fiber, the components of the multicomponent fibers remain in contact with one another as a unitary structure. This can be seen in FIG. 1.

As used herein, through-air bonding or "TAB" means a process of bonding a nonwoven bicomponent fiber web in which air which is sufficiently hot to melt or soften one of the polymers of which the fibers of the web are made is forced through the web. The air velocity is between 100 and 500 feet per minute and the dwell time may be as long as 6 seconds. The melting or softening and resolidification of the polymer provides the bonding. Through air bonding has relatively restricted variability and since through-air bonding (TAB) requires the melting of at least one component to accomplish bonding and is therefore particularly useful in connection with webs with two components like conjugate fibers or those which include an adhesive. In the through-air bonder, air having a temperature above the melting temperature or softening temperature of one component and below the melting temperature or softening temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts or softens the lower melting polymer component and thereby forms bonds between the filaments to integrate the web.

As used herein, the terms "crimp" or "crimped" are intended to mean fibers which have a helical spiral or twist in the fibers. The twist may be two or three-dimensional. Generally, continuous fibers are have three dimensional crimp and staple fibers have a two-dimensional crimp

DETAILED DESCRIPTION OF THE INVENTION

In the following detailed description of the present invention, reference is made to the accompanying drawings which form a part hereof, and which show by way of illustration, specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

The present invention provides a nonwoven web which may be used in a variety of applications. One particular application is as filtration media. The nonwoven web of the present invention is prepared from multicomponent fibers which are partially split. The multicomponent fibers of the nonwoven web are prepared from at least two components, wherein at least one of the components of the multicomponent fibers has a melting point or glass transition temperature which is lower than the other components of the multicomponent fibers. The partially split multicomponent fibers have a longitudinal length and along at least one section of the longitudinal length of the multicomponent fibers, at least one component of the multicomponent fiber has separated from the remaining components of the multicomponent fiber. In addition, along a second section of the longitudinal length of the multicomponent fibers, the components of the multicomponent fibers remain together as a unitary fiber structure. In the present invention, the nonwoven web has a relatively low degree of splitting.

By "low degree of splitting" it is meant that in a test area of the nonwoven web, the total length of the fibers in the test area that are split is between about 0.1% to about 50% of the total length of all of the fibers in the test area. In one embodiment of the present invention, the degree of splitting is between about 0.2% and 25% or more specifically, between about 0.5% and about 15%. If the degree of splitting is above these ranges, the nonwoven web will generally have more of a barrier like property, which will make the nonwoven web undesirable for uses that need permeability, such as in filtration media. If the degree of splitting is within the above ranges, the nonwoven web will be useable as a filtration media.

The nonwoven web may contain only partially split fibers or may contain a mixture of both partially split fibers and unsplit fibers. The unsplit fibers may be multicomponent fibers, monocomponent fibers and mixtures thereof. Generally, the unsplit fibers will be multicomponent fibers which are essentially the same as the partially split multicomponent fibers, but these fibers do not split during the hydroentangling process, which is described in more detail below. Generally, when present, the unsplit fibers may make-up from about 1% to about 99% by weight of the fibers of the nonwoven filter media, with the balance of the fibers being the partially split fibers. The unsplit fibers may be prepared from the same polymers used to prepare the partially split fibers as listed above. When the unsplit fibers are monocomponent fibers, the nonwoven web may be prepared in accordance with known processes, including the processes described in U.S. Pat. No. 6,613,704 to Arnold, which is hereby incorporated by reference. When the unsplit fibers are the same as the multicomponent fibers that become split, the unsplit fiber are generally prepared during the same operation that prepares the fibers which partially split.

The multicomponent fibers which are partially split may be shaped fibers or generally round fibers. Shaped multicomponent fibers are known in art are described in various patents, including U.S. Pat. No. 6,815,383 to Arnold, which is hereby incorporated by reference. The multicomponent fibers may be continuous fibers or may be discontinuous fibers. Continuous fiber webs include, for example, spunbond nonwoven webs. The nonwoven web containing the partially split multicomponent fibers may be any type of nonwoven web including: a spunbond nonwoven web, a meltblown nonwoven web, carded web, airlaid nonwoven web and any other nonwoven web known to those skilled in the art. Generally, for filtration media applications, the nonwoven web is a spunbond nonwoven web or a bonded carded web. The nonwoven web of the present invention may be a single layer nonwoven web structure or may be a layer in a multilayer layer nonwoven web laminate structure.

The multicomponent fibers of the nonwoven web may also be crimped or uncrimped. Crimped fiber nonwoven webs generally will have a lower density or higher bulk than nonwoven webs not containing crimped fibers. Higher bulk or lower density may be advantageous in filter media applications, providing a greater depth or bulk to the filter media using the same amount of material.

If the nonwoven web part of a laminate structure is a multilayer laminate structure, the other layers of the laminate structure may also contain multicomponent partially split fibers, unsplit multicomponent fibers, monocomponent fibers, or a mixture thereof. When the nonwoven is a laminate structure, the addition layers of the laminate structure may be additional layer laminated to the nonwoven web, the additional layer comprising one or more nonwoven webs layers including spunbond nonwoven webs, meltblown nonwoven webs, bonded carded webs, coform nonwoven webs, and/or hydroentangled nonwoven webs or any other known nonwoven web. It is also pointed out that each individual layer of the layered nonwoven laminate may be a different type of nonwoven web. For example, one layer may be a spunbond nonwoven layer and another layer may be a meltblown nonwoven web. The additional layers may or may not contain multicomponent fibers which are partially split. One particular layer that may be used is a meltblown layer which is sandwiched between two spunbond layers, where the spunbond layers contain the partial split multicomponent fibers. Alternatively, another laminate is two different spunbond layers; each containing partially split multicomponent fibers. In the present invention, the nonwoven web containing the partially split multicomponent fibers, which is part of the laminate structure, is generally a spunbond nonwoven web or a bonded carded web.

Generally speaking, to prepare the nonwoven web of the present invention, the multicomponent fibers of the nonwoven web are formed or placed on a support structure. Once formed or placed on the support structure, the multicomponent fibers of the nonwoven web are at least partially bonded, using a method which will partially melt or soften the lower melting point or glass transition temperature component of the fibers, such as thermal bonding. This partial melting or softening of the lower melting point or glass transition temperature component of the multicomponent fibers will cause the individual multicomponent fibers of the nonwoven web to be fused or bonded to adjacent fibers. In the present invention, it is desirable that the nonwoven web not be compressed prior to or during bonding. Compressing the nonwoven web may reduce the air permeability of the nonwoven web to a point that the nonwoven web may have a very low permeability. If the nonwoven web does have a very low permeability, the nonwoven web will not be suitable for uses as a filtration media. One particularly useful method of bonding the nonwoven web in a non-compressive manner is thru-air bonding, which is described above.

Once formed and bonded, the nonwoven web is subjected to a hydraulic treatment process, which is often referred to as "hydraulic entangling" or "hydro entangling". The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present invention may be carried out with any appropriate working fluid such as, for example, water. The working fluid flows through a manifold which evenly distributes the fluid to a series of individual holes or orifices. These holes or orifices may be from about 0.003 to about 0.015 inch in diameter. For example, the invention may be practiced utilizing a manifold produced by Rieter Perfojet S.A. of Montbonnot, France, containing a strip having 0.007 inch diameter orifices, 30 holes per inch, and 1 row of holes. Many other manifold configurations and combinations may be used. For example, a single manifold may be used or several manifolds may be arranged in succession.

The hydroentangling process is used to partially split the multicomponent fiber of the nonwoven web. Generally, the multicomponent fibers split in sections of the multicomponent fiber which are not bonded during the bonding process and remain unsplit in the sections of the multicomponent fibers which are bonded during the bonding process. It is pointed out, however, that the multicomponent fibers may remain unsplit in sections of the multicomponent fibers which are not bonded and may split in sections of the multicomponent fibers which are bonded. In addition, the hydroentangling may result in the fibers of the nonwoven web becoming entangled with one another, thereby further strengthening the nonwoven web. If the multicomponent nonwoven web is part of a multilayer laminate structure, the hydroentangling process may also be used to hold that layers of laminate together, by entangling the fibers of one layer into the fibers of an adjacent layer.

To gain a better understanding of the present invention the partially split multicomponent fibers, attention is directed to the Figures of the present specification. FIG. 1 shows a line drawing of a multicomponent fiber 100 which is partially split. As shown, the multicomponent fiber is a bicomponent fiber, meaning that two separated polymeric components are used to prepare the fiber. The multicomponent fiber 100 has a longitudinal length and along the longitudinal length there is a first section 101 and a second section 102. In the first section 101 of the multicomponent fiber 100, the first component 105 of the multicomponent fiber 100 is separated from the second component 106. In the second section 102, the first component 105 of the multicomponent fiber 100 remains together with the second component 106 such that the two components 105 and 106 remain as a unitary structure. The first section 101 is considered to be the split section of multicomponent fiber 100 and the second section 102 is considered to be the unsplit section of the multicomponent fiber 100. If there are more the two components, at least one of the components of the multicomponent fiber must be split away from the remaining components of the multicomponent fiber in at least one section of the fiber for the fiber to be considered as partially split.

Figure 2:
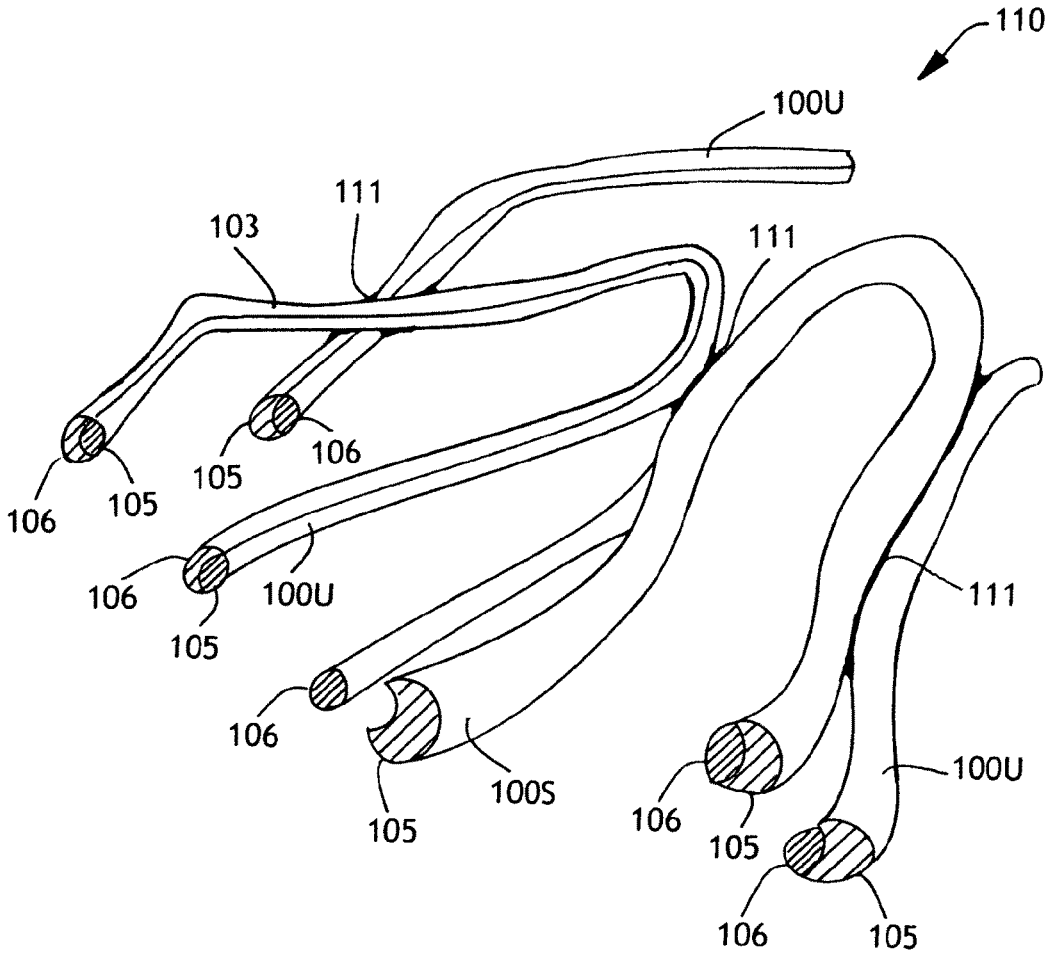
FIG. 2 shows a line drawing of a representation of a portion of a nonwoven web having partially split multicomponent fibers of the present invention.

Attention is now directed to FIG. 2, which shows a line drawing representation of a portion of a nonwoven web 110 having both partially split multicomponent fibers 100S and unsplit multicomponent fibers 100U. In addition, the multicomponent fibers are shown to have bonds 111 between the multicomponent fibers 100S and 100U of the nonwoven web 110. As is shown, the bonds 111 between the multicomponent fibers 100S and/or 100U are at sections of the multicomponent fibers which are unsplit, where the first component 105 and the second component 106 are part of a unitary fiber structure. To achieve the bonding between the multicomponent fibers, one of the components of the multicomponent fibers has a lower melting point or glass transition temperature than the other components of the multicomponent fibers. In the case of the bicomponent fibers shown in FIG. 2, one of the first component 105 or the second component 106 of the bicomponent fibers has a lower melting point or glass transition temperature than the other component. In the practice of the present invention, it does not matter which component of the multicomponent fibers has the lower melting point or glass transition temperature, but for the easy of description of the present invention, the first component of the multicomponent fibers will be arbitrarily designated as having the lower melting point or glass transition temperature.

The multicomponent fibers of the present invention may be prepared from a wide variety of thermoplastic polymers that are known to form the fibers. Examples of these thermoplastic polymers include polyolefins, polyesters, polyamides, polyacrylates, polymethacrylates, polyurethanes, vinyl polymers, fluoropolymers, polystyrene, thermoplastic elastomers, polylactic acid, polyhydroxy alkanates and mixtures thereof.

Examples of suitable polyolefins include polyethylene, e.g., high density polyethylene, low density polyethylene and linear low density polyethylene; polypropylene, e.g., isotactic polypropylene, syndiotactic polypropylene, and blends of isotactic polypropylene and atactic polypropylene; polybutene, e.g., poly(1-butene) and poly(2-butene); polypentene, e.g., poly(1-pentene), poly(2-pentene), poly(3-mehtyl-1-pentene) and poly(4-methyl-1-pentene); copolymers thereof, e.g., ethylene-propylene copolymers; and blends thereof. Suitable copolymers include random and block copolymers prepared from two or more different unsaturated olefin monomers, such as ethylene/propylene and ethylene/butylene copolymers.

Polyolefins using single site catalysts, sometimes referred to as metallocene catalysts, may also be used. Many polyolefins are available for fiber production, for example polyethylenes such as Dow Chemical's ASPUN7 6811A linear low density polyethylene, 2553 LLDPE and 25355 and 12350 high density polyethylene are such suitable polymers. The polyethylenes have melt flow rates, respectively, of about 26, 40, 25 and 12. Fiber forming polypropylenes include Exxon Chemical Company's 3155 polypropylene and Montell Chemical Co.'s PF-304. Many other polyolefins are commercially available.

Suitable polyesters include polyethylene terephthalate, polytrimethylene terephthalate, polybutylene terephthalate, polytetramethylene terephthalate, polycyclohexylene-1,4-dimethylene terephthalate, and isophthalate copolymers thereof, as well as blends thereof. Biodegradable polyesters such as polylactic acid and copolymers and blends thereof may also be used. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Examples of vinyl polymers are polyvinyl chloride, and polyvinyl alcohol.

In accordance with one embodiment of the present invention, particularly suitable multicomponent fibers are bicomponent fibers. These bicomponent fibers may be prepared from any two of the above described thermoplastic polymers. In one particular embodiment of the present invention, both components of the multicomponent fibers are polyolefin-polyolefin, e.g., polyethylene-polypropylene and polyethylene-polybutylene. Of these pairs, more particularly desirable are polyolefin-polyolefin pairs, e.g., linear low density polyethylene-isotactic polypropylene, high density polyethylene-isotactic polypropylene and ethylene-propylene copolymer-isotactic polypropylene.

Generally, splitting of the multicomponent fibers will more readily occur if the components of the multicomponent fibers are somewhat incompatible with one another. This incompatibility may assist the individual components of the fibers to separate from one another when subjected to the fluid jets of the hydroentangling process, which is described below. Therefore, in one embodiment of the present invention, the components of the multicomponent fibers should be selected such that one of the components is incompatible with the other components. A good example of two components that are incompatible with one another are polyethylene and polypropylene. In addition, polyethylene typically has a lower melting point than polypropylene, which results in the polyethylene component of the multicomponent fibers forming the bonds between the multicomponent fibers.

The multicomponent fiber of the nonwoven filter media may be substantially continuous fibers, staple fibers, or mixtures thereof. Examples of substantially continuous fiber containing nonwoven webs include webs made by a spunbonding process, a meltblown process, or any other process known to those skilled in the art which generates substantially continuous fibers. When staple fibers are used, methods known to those skilled in the art for forming staple fibers nonwoven webs, including, airlaying, carding and the like may be used. The multicomponent fibers making up the nonwoven webs may be crimped, uncrimped or a mixture of crimped and uncrimped fibers.

Generally, the multicomponent fibers which are splitable typically have more than one component at an outer surface 103 of the multicomponent fibers 100. As can be seen in FIG. 2, each component 105 and 106 of the multicomponent fibers 100, which are represented as bicomponent fibers, makes up a portion of the outer surface 103 of the bicomponent fibers 100. By having one or more of the components at the outer surface 103 of the multicomponent fibers 100, the components of the fibers will more readily split form one another, when external energy is applied to the fibers. The percentage of area of the outer surface which is each component of the multicomponent fibers is not critical to the present invention, but generally, in order for the components to split, the minimum surface area should be about 1% of the total surface area of the outer surface of the multicomponent fibers. This type of configuration of the components of the multicomponent fibers is known in the art as a side-by-side configuration. Other configurations commonly used for multicomponent fibers, such as a sheath-core configuration where one of the components completely surrounds the other components of the multicomponent fibers. Sheath-core configurations may or may not result in multicomponent fibers which can be effectively split.

The multicomponent fibers have from about 20% to about 80%, preferably from about 40% to about 60%, by weight of the low melting polymer and from about 80% to about 20%, preferably about 60% to about 40%, by weight of the high melting polymer.

Figure 3:
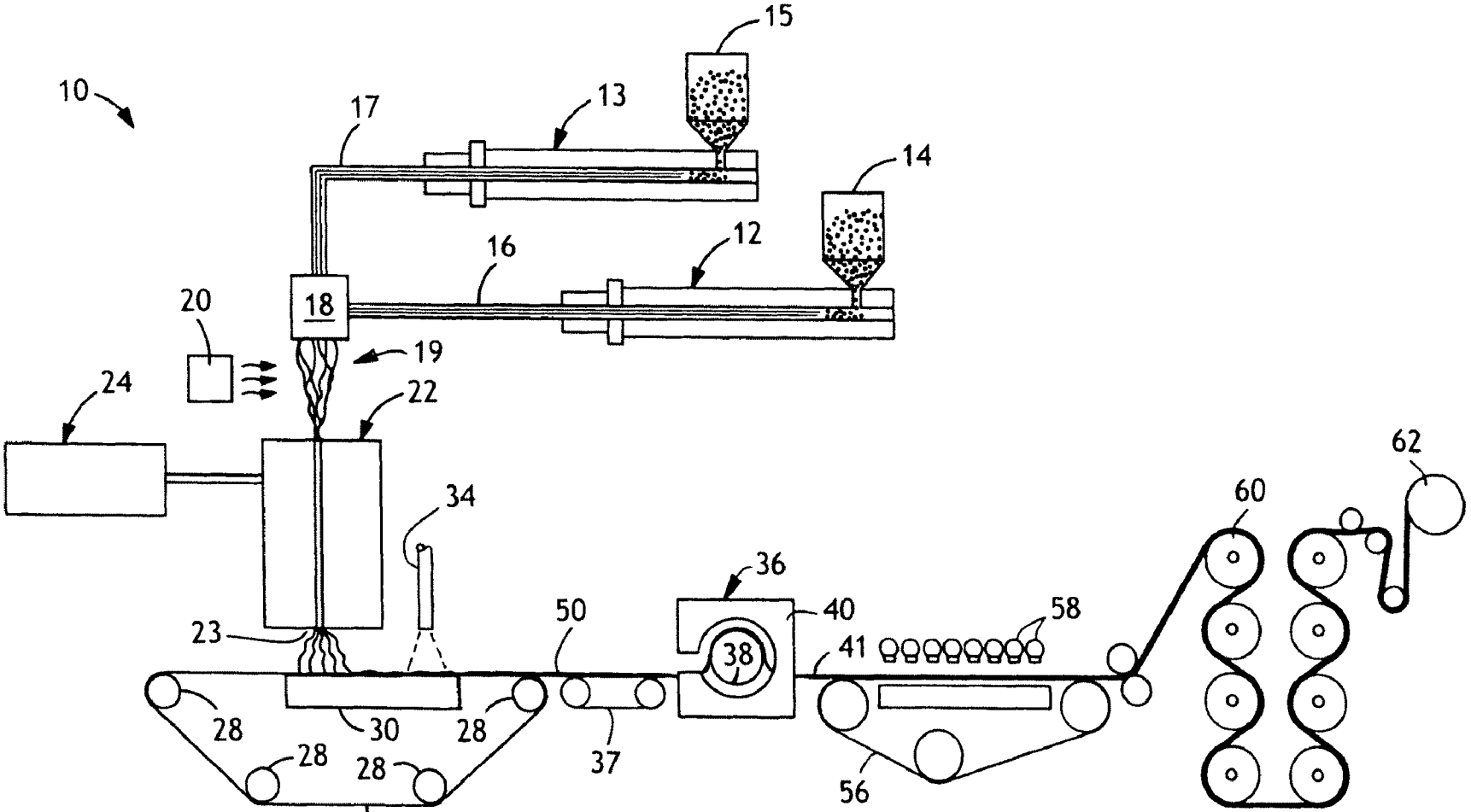
FIG. 3 shows a schematic diagram of a process which may be used to prepare a partially split bicomponent spunbond nonwoven web of the present invention.

In one particular embodiment of the present invention, the nonwoven web is prepared using a spunbond process. Once the nonwoven web is prepared, the nonwoven web is bonded using a non-compressive means and then subjected to a hydroentangling treatment. In order to obtain a better understanding of a process to prepare the nonwoven web of the present invention, attention is directed to FIG. 3. As is shown in FIG. 3, a process line 10 for multicomponent spunbond fibers is shown. The process line 10, as shown, is specifically arranged to produce bicomponent continuous fibers, but it should be understood that the present invention comprehends nonwoven webs made with multicomponent fibers having more than two components. For example, the nonwoven webs of the present invention can be made with fibers having three, four, or more components. The fibers may have a side-by-side configuration.

The process line 10 includes a pair of extruders 12 and 13 for separately extruding polymer component A and polymer component B. For the purposes of this description, it is assumed that polymer component A has a higher melting point or glass transition temperature than polymer component B. Polymer component A is fed into the respective extruder 12 from a first hopper 14 and polymer component B is fed into the respective extruder 13 from a second hopper 15. Polymer components A and B are fed from the extruders 12 and 13 through respective polymer conduits 16 and 17 to a spinneret 18. Spinnerets for extruding bicomponent fibers are well-known to those of ordinary skill in the art and thus are not described here in detail.

Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of fibers when the polymers are extruded through the spinneret. For the purposes of the present invention, spinneret 18 may be arranged to form side-by-side bicomponent fibers.

The process line 10 also includes a quench blower 20 positioned adjacent to the curtain of fibers extending from the spinneret 18. Air from the quench air blower 20 quenches the fibers extending from the spinneret 18. The quench air can be directed from one side of the fiber curtain as shown in FIG. 3, or both sides of the fiber curtain.

A fiber draw unit ("FDU") or aspirator 22 is positioned below the spinneret 18 and receives the quenched fibers. Fiber draw units or aspirators for use in melt spinning polymers are well-known as discussed above. Suitable fiber draw units for use in the process of the present invention include a linear fiber aspirator of the type shown in U.S. Pat. No. 3,802,817 and eductive guns of the type shown in U.S. Pat. Nos. 3,692,618 and 3,423,266, which are hereby incorporated herein by reference in their entirety. Generally described, the fiber draw unit 22 includes an elongate vertical passage through which the fibers are drawn by aspirating air entering from the sides of the passage and flowing downwardly through the passage. A blower 24 supplies aspirating air to the fiber draw unit 22. The aspirating air draws the fibers and air above the fiber draw unit through the fiber draw unit. The aspirating air in the formation of the post formation crimped fibers is unheated and is at or about ambient temperature. The ambient temperature may vary depending on the conditions surrounding the apparatus used in the process of FIG. 3. Generally, the ambient air is in the range of about 65° F. (18.3° C.) to about 85° F. (29.4° C.); however, the temperature may be slightly above or below this range, depending on the conditions of the ambient air around the fiber draw unit.

Alternatively, the blower 24 may be set to supply aspirating air to the fiber draw unit 22 which is heated. Depending on the polymers used to make the multicomponent fibers, supplying heated air to the fiber draw unit 22 may result in the fibers being crimped in the fiber draw unit. Using a heated fiber draw unit 22 is known in the art and is described in detail in U.S. Pat. No. 5,382,400 to Pike et al., which is hereby incorporated by reference.

An endless forming surface 26 is positioned below the fiber draw unit 22 and receives the continuous fibers from the outlet opening 23 of the fiber draw unit. The forming surface 26 is a belt and travels around guide rollers 28. A vacuum 30 positioned below the forming surface 26 where the fibers are deposited draws the fibers against the forming surface. Although the forming surface 26 is shown as a belt in FIG. 3, it should be understood that the forming surface can also be in other forms such as a drum.

The fibers of the nonwoven web are then optionally heat treated by traversal under one of a hot air knife (HAK) or hot air diffuser 34. Generally, it is preferred that the fibers of the nonwoven web are heat treated. A conventional hot air knife includes a mandrel with a slot that blows a jet of hot air onto the nonwoven web surface. Such hot air knives are taught, for example, by U.S. Pat. No. 5,707,468 to Arnold, et al. A hot air diffuser is an alternative to the HAK which operates in a similar manner but with lower air velocity over a greater surface area and thus uses correspondingly lower air temperatures. Depending on the conditions of the hot air diffuser or hot air knife (temperature and air flow rate) the fibers may receive an external skin melting or a small degree of bonding during this traversal through the first heating zone. This bonding is usually only sufficient only to hold the fibers in place during further processing; but light enough so as to not hold the fibers together when they need to be manipulated manually. Such bonding may be incidental or eliminated altogether, if desired. The heat treatment also serves to activate the latent crimp which may be present in the fibers.

As shown, the unbonded nonwoven web of fibers 50 is then passed out of the first heating zone of the hot air knife or hot air diffuser 34 to a second wire 37 where the fibers continue to cool and where the below wire vacuum 30 is discontinued so as to not disrupt crimping. It is noted that the second wire 37 may be an extension of the forming surface 26 or a separate wire. Crimping is a result of the differential cooling of the components of the fibers. As the fibers cool, the fibers may tend to crimp in the z-direction, or out of the plane of the web, and form a higher loft nonwoven web. If a hot air knife or hot air diffuser is not present, and the fiber draw unit is heated, upon cooling of the fibers, the fibers may crimp. Crimping is dependent on several factors, including the polymeric materials used to make the fibers, and the orientation of the polymeric components in the resulting fibers, among other factors.

The process line 10 further includes one or more bonding devices, such as a through-air bonder 36. Through-air bonders are well-known to those skilled in the art and are not discussed here in detail. Generally described, a through-air bonder 36 includes a perforated roller 38, which receives the web, and a hood 40 surrounding the perforated roller. A conveyor 37 transfers the unbonded nonwoven web 50 from the forming surface to the through-air bonder.

It should be understood; however, that other through-air bonding arrangements are suitable to practice the present invention. For example, when the forming surface is a belt, the forming surface may be routed directly through the through-air bonder. Alternatively, when the forming surface is a drum, the through-air bonder can be incorporated into the same drum so that the web is formed and bonded on the same drum. Other bonding means such as, for example, oven bonding, or infrared bonding processes which effects interfiber bonds without applying significant compacting pressure may be used in place of the through air bonder.

As is shown in FIG. 3, the bonded nonwoven web 41 is then hydraulically entangled, which is also called hydroentangling, when water is used as the high pressure fluid. Generally, the hydroentangling is accomplished while the bonded nonwoven web 41 is supported on an apertured support 56. Streams of liquid from jet devices 58 are impinged on the bonded nonwoven web 41. It will be appreciated that the process could be readily varied in order to treat each side of the bonded substrate web 41 in a continuous line. After the bonded substrate 41 has been hydraulically entangled, it may be dried by drying cans 60 and wound on a winder 62.

Alternatively, the bonded nonwoven web 41 may be wound on to a winding roll so that the bonded nonwoven web may be stored prior to hydroentangling or transported to a hydroentangling process located at a different location. It may be advantageous to produce the bonded nonwoven web on a process line separate from the hydroentangling process, since the hydroentangling process generally operates at slower line speeds than the bonded nonwoven web forming process.

To gain a better understanding of the process, a description of the process using polyethylene and polypropylene as the polymeric components is provided. To operate the process line 10, the hoppers 14 and 15 are filled with the respective polymer components A and B. Polymer components A and B are melted and extruded by the respective extruders 12 and 13 through polymer conduits 16 and 17 and the spinneret 18. Although the temperatures of the molten polymers vary depending on the polymers used, when polypropylene and polyethylene are used as component A and component B respectively, the preferred temperatures of the polymers range from about 370° F. (187° C.) to about 530° F. (276° C.) and preferably range from 400° F. (204° C.) to about 450° F. (232° C.).

As the extruded fibers extend below the spinneret 18, a stream of air from the quench blower 20 at least partially quenches the fibers to develop a latent crimp in the fibers. The quench air preferably flows in a direction substantially perpendicular to the length of the fibers at a temperature of about 45° F. (7° C.) to about 90° F. (32° C.) and a velocity from about 100 to about 400 feet per minute (about 30.5 to about 122 meters per minute). The fibers must be quenched sufficiently before being collected on the forming surface 26 so that the fibers can be arranged by the forced air passing through the fibers and forming surface. Quenching the fibers reduces the tackiness of the fibers so that the fibers do not adhere to one another too tightly before being bonded and can be moved or arranged on the forming surface during collection of the fibers on the forming surface and formation of the web.

After quenching, the fibers are drawn into the vertical passage of the fiber draw unit 22 by a flow of ambient air from the blower 24 through the fiber draw unit. Optionally, the air from the blower may be heated. The fiber draw unit is preferably positioned 30 to 60 inches (0.76 to 1.5 meters) below the bottom of the spinneret 18. The fibers are deposited through the outlet opening 23 of the fiber draw unit 22 onto the traveling forming surface 26, and as the fibers are contacting the forming surface, the vacuum 20 draws the fibers against the forming surface to form an unbonded, nonwoven web of continuous fibers.

As discussed above, because the fibers are quenched, the fibers are not too tacky and the vacuum can move or arrange the fibers on the forming surface as the fibers are being collected on the forming surface and formed into the web. If the fibers are too tacky, the fibers stick to one another and cannot be arranged on the surface during formation of the web.

After the fibers are collected on the forming surface 26, the fibers are optionally heat treated using a hot air knife or a hot air diffuser 34. The heat treatment serves one of two functions. First, the heat treatment serves to activate the latent crimp. Second, the heat treatment may serve as a preliminary bonding for the nonwoven web so that the web can be mechanical handled through the forming apparatus without damage.

When the spunbond fibers are crimped, the fabric of the present invention characteristically has a relatively high loft and is relatively resilient. The crimp of the fibers creates an open web structure with substantial void portions between fibers and the fibers are bonded at points of contact of the fibers. The temperature required to activate the latent crimp of most bicomponent fibers ranges from about 110° F. (43.3° C.) to a maximum temperature at or about melting point or glass transition temperature of polymer component B. The temperature of the air from the hot air knife or hot air diffuser can be varied to achieve different levels of crimp. Generally, a higher air temperature produces a higher number of crimps. The ability to control the degree of crimp of the fibers is particularly advantageous because it allows one to change the resulting density, pore size distribution and drape of the fabric by simply adjusting the temperature of the heat treatment.

When preliminary bonding is desired or needed, a hot air knife 34 or hot air diffuser is used and directs a flow of air having a temperature above the melting temperature of the lowest temperature melting component of the multicomponent fibers, which is the sheath component when a sheath core configuration is used, through the web and forming surface 26. Preferably, the hot air contacts the web across the entire width of the web. The hot air melts or softens the lower melting point or temperature component and thereby forms bonds between the bicomponent fibers to integrate the web. For example, when polypropylene and polyethylene are used as polymer components, polyethylene should be the sheath component if the fibers are in a sheath/core multicomponent fiber, the air flowing from the hot air knife or hot air diffuser preferably has a temperature at the web surface ranging from about 230° F. (110° C.) to about 500° F. (260° C.) and a velocity at the web surface from about 1000 to about 5000 feet per minute (about 305 to about 1524 meters per minute). It is noted; however, the temperature and velocity of the air from the hot air knife 34 may vary depending on factors such as the polymers which form the fibers, the thickness of the web, the area of web surface contacted by the air flow, and the line speed of the forming surface. It is noted that the if temperature of the air flowing from the hot air knife or the hot air diffuser is too hot, crimping of the fibers may not occur. Furthermore, the fibers may be heated by methods other than heated air such as exposing the fibers to electromagnetic energy such as microwaves or infrared radiation. In preparing the high loft material from polyethylene and polypropylene as the components of the bicomponent fibers, the hot air knife is operated at a temperature from about 200° F. (93° C.) to about 310° F. (154° C.) and a pressure of about 0.01 to about 1.5 inches (0.25-38.1 mm) of water. In addition, the HAK for the high loft layer is generally set about 3 to about 8 inches (76.2-203 mm) above the forming wire.

After the heat treatment of the fibers, the nonwoven web of fibers is then passed from the heat treatment zone of the hot air knife or hot air diffuser 34 to a second wire 37 where the fibers continue to cool and where the below wire vacuum 30 is discontinued. Alternatively, the nonwoven web remains on the forming surface 26 and a vacuum is pulled below the forming surface. As the fibers cool and are removed from the vacuum, the fibers will crimp, in the z-direction, or out of the plane of the web, thereby forming a high loft, low density nonwoven web 50, if latent crimp is present in the fibers and the latent crimp is activated.

After being optionally heat treated, the nonwoven web 50 is transferred from the forming surface 26 to the through-air bonder 36 with a conveyor 37 for more thorough bonding which will set, or fix, the web at a desired degree of loft and density achieved by the crimping of the fibers. In the through-air bonder 36, air having a temperature above the melting temperature or softening temperature of lower melting point or glass transition temperature component is directed from the hood 40, through the web, and into the perforated roller 38. As with the hot air knife 34, the hot air in the through-air bonder 36 melts or softens the lower melting point or glass transition temperature component and thereby forms bonds between the bicomponent fibers to integrate the web. When polypropylene and polyethylene are used as polymer components A and B respectively, the air flowing through the through-air bonder preferably has a temperature ranging from about 230° F. (110° C.) to about 280° F. (138° C.) and a velocity from about 100 to about 500 feet per minute (about 30.5 to about 152.4 meters per minute). The dwell time of the web in the through-air bonder 36 is preferably less than about 6 seconds. It should be understood, however, that the parameters of the through-air bonder 36 also depend on factors such as the type of polymers used and thickness of the web. The nonwoven web after it is bonded in the through-air bonder 36 is bonded such that the fibers are somewhat fixed in their location in the nonwoven web resulting in a "fixed web" 41.

As an alternative to the heating zone using a combination of a hot air knife or a hot air diffuser with the through air bonder, the through air bonding (TAB) unit 40 can be zoned to provide a first heating zone in place of the hot air knife or hot air diffuser 34, followed by a cooling zone, which is in turn followed by a second heating zone sufficient to fix the web. The fixed web 41 can then be collected on a winding roll (not shown) or the like for later use. In this alternative configuration, when the web passes through a cool zone that reduces the temperature of the polymer below its crystallization temperature, the lower melting point polymer recrystallizes. In the case of a bicomponent fiber from polyethylene and polypropylene, since polyethylene is a semi-crystalline material, the polyethylene chains recrystallize upon cooling causing the polyethylene to shrink. This shrinkage induces a force on one side of the side-by-side fibers that may allow the fibers to crimp or coil if there are no other major forces restricting the fibers from moving freely in any direction.

As is stated above, after bonding the nonwoven web may be wound on a roll for processing at a later date or at a different location, for example. As is shown in FIG. 3, the nonwoven web is further processed in-line using a hydroentangling process. The hydroentangling of the present invention may be carried out with any appropriate working fluid such as, for example, water. The working fluid flows through a manifold which evenly distributes the fluid to a series of individual holes or orifices. These holes or orifices may be, for example, from about 0.003 to about 0.015 inch in diameter and may be arranged in one or more rows with any number of orifices, e.g. 40-100 per inch, in each row. Many other manifold configurations may be used, for example, a single manifold may be used or several manifolds may be arranged in succession. The bonded multicomponent nonwoven web may be supported on an apertured support, while treated by streams of liquid from jet devices. The support can be a mesh screen or forming wires. The support can also have a pattern so as to from a nonwoven material with such a pattern therein.

Generally, in the present invention, the hydraulic entangling process is carried out by passing the working fluid through the orifices at a pressures ranging from about 200 to about 3000 pounds per square inch gage (psig). The actually pressure of the working fluid will depend on many factors, including the line speed at which the nonwoven web is run through the process, the degree of entangling desired, the degree of splitting desired and other factors. Generally, the faster the nonwoven web is run through the hydroentangling process will require greater fluid pressure to achieve the desired level of splitting or entanglement. It is not the water pressure alone which results in the splitting and entanglement of the fibers, rather it is the impact force and energy applied to the nonwoven web. Energy (E) and impact force (I) may be calculated using the following formula:

$$E=0.125(YPG/sb)$$

and $$I=PA$$

where

Y is the number of orifices per linear inch;

P is the pressure of the liquid in the manifold in p.s.i.g.;

G is the volumetric flow in cubic feet/minute/orifice;

s is the speed of passage of the web under the streams in feet/minute; and b is the weight of fabric produced in osy (ounces per square yard); and A is the cross-sectional area of the jets in square inches.

Energy Impact Product is Ex/which is in HP-hr-lb-force/IbM (horsepower-hour-pound-force/pound-mass). Desirably, generating the hydroentangled webs of the present invention will involve employing water pressures from about 200 to 3000 psi, more desirably from about 400 to 1500 psi. Typically, the lowest fluid pressure necessary to achieve the desired degree of splitting in the nonwoven web will be selected, since lower pressures uses less energy and lowers recycling cost for the entangling fluid. In addition, the hydroentangled nonwoven web may be subjected to additional hydroentangling steps to increase the degree of separation of the components of the individual fibers.

In the hydroentangling process, the nonwoven web is supported by a forming surface and the fluid impacts the nonwoven web on the forming surface. Typically, the forming surface may be a single plane mesh having a mesh size of from about 40×40 to about 100×100 or any mesh size therebetween. The forming surface may also be a multi-ply mesh having a mesh size from about 50×50 to about 200×200 or any mesh size therebetween. As is typical in many water jet treatment processes, a vacuum slot may be located directly beneath the manifolds or beneath the forming surface downstream of the entangling manifold so that excess water is withdrawn from the resulting hydraulically entangled nonwoven web.

After the fluid jet treatment, the nonwoven web 41 may be transferred to a non-compressive drying operation. Suitable non-compressive drying processes includes, for example, a through-air drier (not shown) and/or drying cans and wound onto a winder. Non-compressive drying of the web may be accomplished utilizing a conventional rotary drum through-air drying apparatus shown in which has a similar configuration to the through-air bonder 36. As with the through-air dryer, the through-dryer may be a rotatable cylinder with perforations in combination with an outer hood for receiving hot air blown through the perforations. A through-dryer belt carries the composite material over the upper portion of the outer rotatable cylinder. The heated air forced through the perforations in the outer rotatable cylinder of the through-dryer removes water from the resulting nonwoven web. The temperature of the air forced through the nonwoven web by the through-dryer 42 may range from about 200° to about 500° F. The actual temperature used is dependent of the materials used to prepare the nonwoven web and the amount of water retained by the nonwoven web. As shown in FIG. 3, smaller drying cans 60, may be operated at different temperature to achieve drying of the hydroentangled nonwoven web. Other useful through-drying methods and apparatus may be found in, for example, U.S. Pat. Nos. 2,666,369 and 3,821,068, the contents of which are incorporated herein by reference.

The hydroentangling process is used to cause the multicomponent fibers of the nonwoven web to become partially split. It is also believed that the hydroentangling process will impart a charge to the hydroentangled nonwoven web, making it especially useable as a filter material. This charge imparted to the nonwoven web is known as a "hydrocharging". Hydrocharging is described in more detail in U.S. Pat. No. 5,496,507. Hydrocharging enhances the ability of the nonwoven web to electrostatically attract and retain particles to the fibers of the nonwoven web.

In addition to the hydrocharging, the nonwoven web may be further electret charged. Electret charging or treating processes suitable for the present invention are known in the art. These methods include thermal, plasma-contact, electron beam and corona discharge methods. For example, U.S. Pat. No. 4,375,718 to Wadsworth et al., U.S. Pat. No. 5,401,446 to Tsai et al. and U.S. Pat. No. 6,365,088 B1 to Knight et. al., each incorporated by reference disclose electret charging processes for nonwoven webs.

Figure 4:
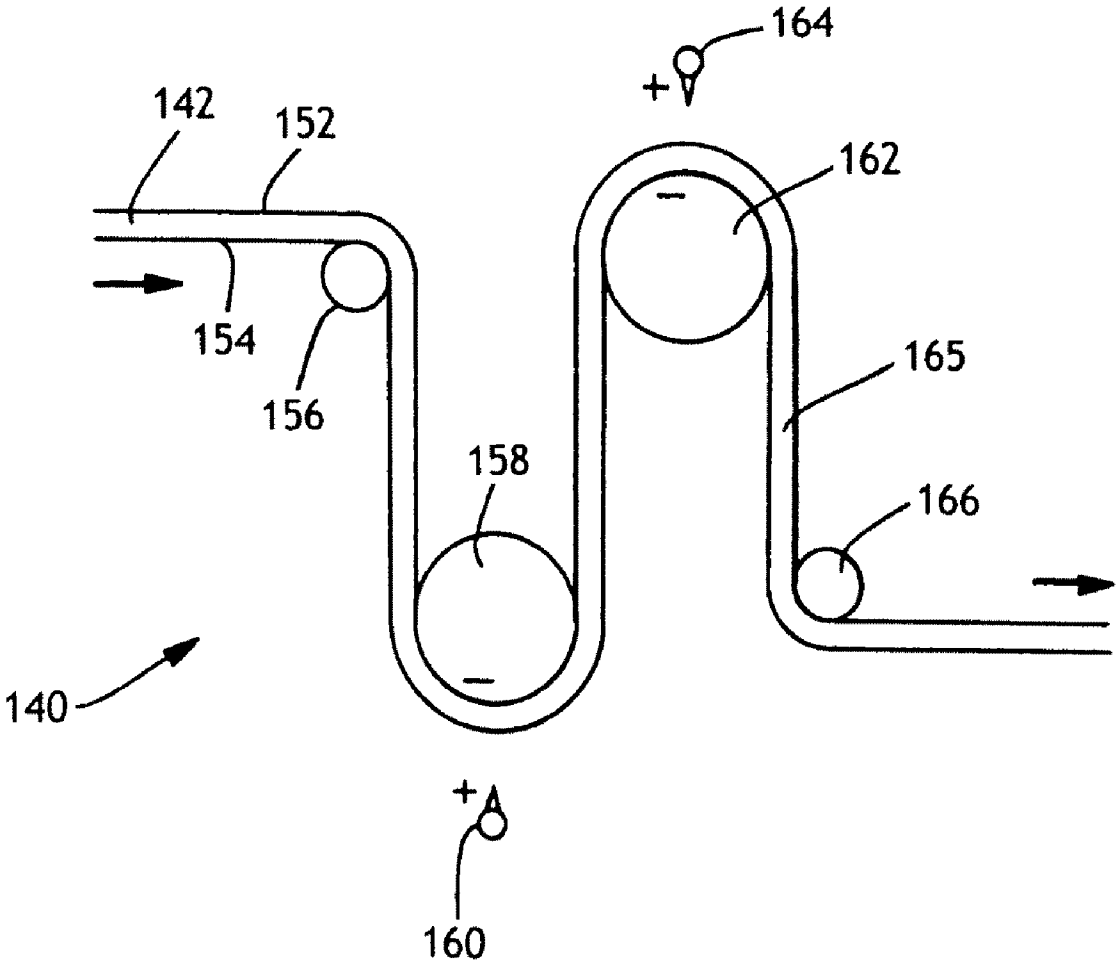
FIG. 4 shows a schematic diagram of an electret treating process for a nonwoven web of the present invention.

Each side of the nonwoven web can be conveniently electret charged by sequentially subjecting the web to a series of electric fields such that adjacent electric fields have substantially opposite polarities with respect to each other. For example, one side of web is initially subjected to a positive charge while the other side is subjected to a negative charge, and then the first side of the web is subjected to a negative charge and the other side of the web is subjected to a positive charge, imparting permanent electrostatic charges in the web. A suitable apparatus for electret charging the nonwoven web is illustrated in FIG. 4. An electret charging apparatus 140 receives a nonwoven web 142 having a first side 152 and a second side 154. The web 142 passes into the apparatus 140 with the second side 154 in contact with guiding roller 156. Then the first side 152 of the web 142 comes in contact with a first charging drum 158 which rotates with the web 142 and brings the web 142 into a position between the first charging drum 158 having a negative electrical potential and a first charging electrode 160 having a positive electrical potential. As the web 142 passes between the charging electrode 160 and the charging drum 158, electrostatic charges are developed in the web 142. A relative positive charge is developed in the first side 152 and a relative negative charge is developed in the second side 154. The web 142 is then passed between a negatively charged second drum 162 and a positively charged second electrode 164, reversing the polarities of the electrostatic charge previously imparted in the web and permanently imparting the newly developed electrostatic charge in the web. The electret charged web 165 is then passed on to another guiding roller 166 and removed from the electret charging apparatus 140. It is to be noted that for discussion purposes, the charging drums are illustrated to have negative electrical potentials and the charging electrodes are illustrated to have positive electrical potentials. However, the polarities of the drums and the electrodes can be reversed and the negative potential can be replaced with ground. In accordance with the present invention, the charging potentials useful for electret forming processes may vary with the field geometry of the electret process. For example, the electric fields for the above-described electret charging process can be effectively operated between about 1 KVDC/cm and about 30 KVDC/cm, desirably between about 4 KVDC/cm and about 20 KVDC/cm, and still more particularly about 7 kVDC/cm to about 12 kVDC/cm. when the gap between the drum and the electrodes is between about 1.2 cm and about 5 cm. The above-described suitable electret charging process is further disclosed in above-mentioned U.S. Pat. No. 5,401,446, which in its entirety is herein incorporated by reference Electret charge stability can be further enhanced by grafting polar end groups onto the polymers of the multicomponent fibers. In addition, barium titanate and other polar materials may be blended with the polymers to enhance the electret treatment. Suitable blends are described in U.S. Pat. No. 6,162,535 to Turkevich et al, assigned to the assignee of this invention and in U.S. Pat. No. 6,573,205 B1 to Myers et al, hereby incorporated by reference.

Other methods of electret treatment are known in the art such as that described in U.S. Pat. No. 4,375,718 to Wadsworth, U.S. Pat. No. 4,592,815 to Nakao, U.S. Pat. No. 6,365,088 and U.S. Pat. No. 4,874,659 to Ando, each hereby incorporated in its entirety by reference.

The nonwoven web of the present invention is particularly adapted to be used as a filtration media. It has been discovered that hydroentangled nonwoven web containing multicomponent fibers which are partially split, has an improvement in the filtration efficiency without a large increase in the pressure drop across the filter as compared to a filter produced from only multicomponent fibers which are not partially split or hydroentangled.

When used as a filtration material, the nonwoven webs or laminates described herein may be placed into filter frames, formed into filter bags or be formed into any shape or size typically used in the art for filters. In addition, the nonwoven web or laminate may be first pleated prior being used as a filter media.

Test Procedures

Air Filtration Efficiency Measurements: The air filtration efficiencies of the substrates discussed below were evaluated using a TSI, Inc. (St. Paul, Minn.) Model 8130 Automated Filter Tester (AFT). The Model 8130 AFT measures particle filtration characteristics for air filtration media. The AFT utilizes a compressed air nebulizer to generate a submicron aerosol of sodium chloride particles which serves as the challenge aerosol for measuring filter performance. The characteristic size of the particles used in these measurements was 0.1 micrometer count mean diameter. Typical air flow rates were between 80 liters per minute and 85 liters per minute. The AFT test was performed on a sample area of about 100 $cm^2$. The performance or efficiency of a filter medium is expressed as the percentage of sodium chloride particles which penetrate the filter. Penetration is defined as transmission of a particle through the filter medium. The transmitted particles were detected downstream from the filter. Light scattering was used for the detection and counting of the sodium chloride particles both upstream of the filter and downstream of the filter. The Model 8130 Automated Filter Tester (AFT) displays the downstream particle percentage. The percent efficiency ($\epsilon$) may be calculated from the percent penetration according to the formula:

$$\epsilon = 100\% - \text{the downstream particle percentage}$$

Further information regarding the TSI Model 8130 AFT or the test procedures used to perform the efficiency test using the TSI Model 8130 may be obtained from TSI and at www.tsi.com.

Air Permeability: The Air Permeability of the nonwoven fabric of the present invention is determined by a test that measures the air permeability of fabrics in terms of cubic feet of air per square foot of sheet using a Textest FX3300 air permeability tester manufactured by Textest Ltd., Zurich, Switzerland. All tests are conducted in a laboratory with a temperature of 23+/−2° C. and 50+/−5% RH. Specifically, a piece of the nonwoven web to be tested is clamped over the 2.75-inch diameter fabric test opening. Placing folds or crimps above the fabric test opening is to be avoided if at all possible. The unit is turned on and the Powerstat is slowly turned clockwise until the inclined manometer oil column reaches 0.5. Once the inclined manometer oil level has steadied at 0.5, the level of oil in the vertical manometer is recorded. The vertical manometer reading is converted to a flow rate in units of cubic feet of air per minute per square foot of sample.

ASHRAE 52.2-1999: Method of Testing General Ventilation Air Cleaning Devices for Removal Efficiency by Particle Size This test, which is a filter industry standard test has a standard procedure which is incorporated by reference. In summary, the test measures the efficiency of a filter medium in removing particles of specific diameter as the filter becomes loaded with standardized loading dust. The loading dust is fed at interval stages to simulate accumulation of particles during service life. The challenge aerosol for filtration efficiency testing is solid-phase potassium chloride (KCl) generated from an aqueous solution. An aerosol generator products KCl particles in twelve size ranges for filtration efficiency determination. The minimum efficiency observed over the loading sequence for each particle size range is used to calculate composite average efficiency values for three particle size ranges: 0.3 to 1.0 micron, 1.0 to 3.0 microns, and 3.0 to 10 microns. Sample of the filter material were pleated into a configuration which is 24 inches×24 inches×2 inches.

The loading dust used to simulate particle accumulation in service is composed, by weight, of 72% SAE Standard J726 test dust (fine), 23% powdered carbon, and 5% milled cotton linters. The efficiency of clean filler medium is measured at one of the flow rates specified in the standard. A feeding apparatus then sends a flow of dust particles to load the filter medium to various pressure rise intervals until the specified final resistance is achieved. The efficiency of the filter to capture KCl particles is determined after each loading step. The efficiency of the filter medium is determined by measuring the particle size distribution and number of particles in the air stream, at positions upstream and downstream of the filter medium. The particle size removal efficiency ("PSE") is defined as:

$$PSE = 100 \times (1 - (\text{downstream particle count}/\text{upstream particle count}))$$

The particle counts and size can be measured using a HIAC/ROYCO Model 8000 automatic particle counter and a HIAC/ROYCO Model 1230 sensor.

The results of this test procedure are reported in MERV (minimum efficiency rating). The higher the MERV value, the more efficient the filter is in filtering the gases.

EXAMPLE 1

Figure 5:
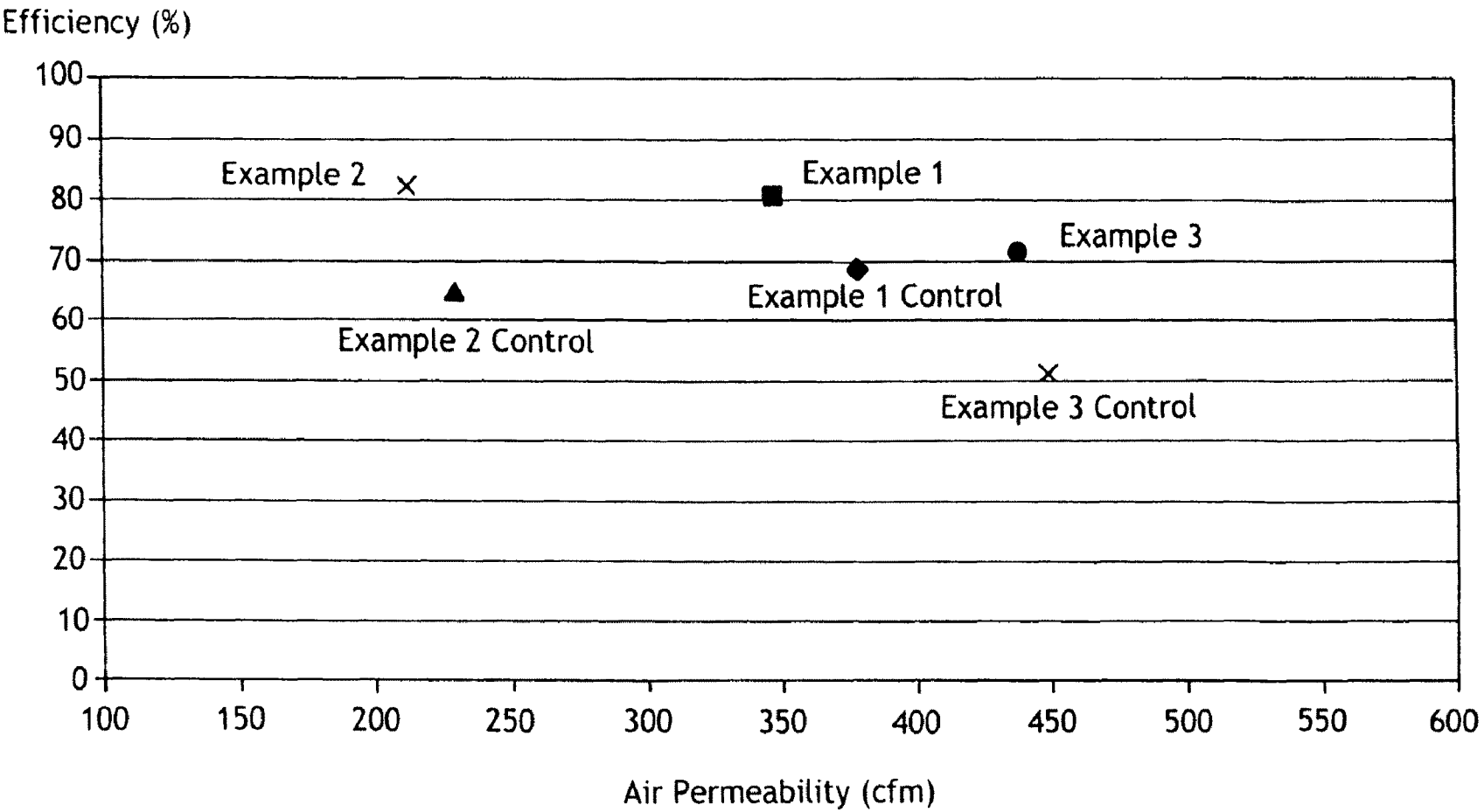
FIG. 5 shows a chart of the improvement in the efficiency and change in permeability of a nonwoven web of the present invention as compared to a control.

A pentalobel shaped bicomponent fiber spunbond nonwoven web was prepared in accordance with FIG. 3, except the hydroentangling was conducted off-line rather than in-line. The bicomponent fibers are prepared from 50% by weight of a linear low density polyethylene and 50% by weight of isotactic polypropylene, in a side by side configuration. The nonwoven web has a basis weight of about 93 grams per square meter (gsm) and a bulk density of about 0.0367 g/cm$^3$. As a control a portion of the nonwoven web was not hydroentangled. Another portion of the nonwoven web was hydroentangled with 2 injectors at a pressure of 700 psi with a single pass through the injectors. Hydroentangling was performed at a line speed of about 600 feet per minute. Air permeability and efficiency were determined using the test procedures described above and are plotted on FIG. 5.

A second sample of the control and the hydroentangled filter material were tested under ASHRAE 52.2 1999 test described above. The control had a MERV 11 rating with a 0.32 inches of water pressure drop while the hydroentangled filter media had a MERV 12 rating with a 0.32 inches of water pressure drop.

EXAMPLE 2

A pentalobel shaped bicomponent fiber spunbond nonwoven web was prepared in accordance with FIG. 3, except the hydroentangling was conducted off-line rather than in-line. The bicomponent fibers are prepared from 50% by weight of a linear low density polyethylene and 50% by weight of isotactic polypropylene, in a side by side configuration. The nonwoven web has a basis weight of about 68 grams per square meter (gsm) and a bulk density of about 0.0393 g/cm$^3$. As a control a portion of the nonwoven web was not hydroentangled. Another portion of the nonwoven web was hydroentangled with 2 injectors at a pressure of 700 psi with a single pass through the injectors. Hydroentangling was performed at a line speed of about 600 feet per minute. Air permeability and efficiency were determined using the test procedures described above and are plotted on FIG. 5.

A second sample of the control and the hydroentangled filter material were tested under ASHRAE 52.2 1999 test described above. The control had a MERV 8 rating with a 0.26 inches of water pressure drop while the hydroentangled filter media had a MERV 12 rating with a 0.27 inches of water pressure drop.

EXAMPLE 3

Round bicomponent fiber spunbond nonwoven web was prepared in accordance with FIG. 3, except the hydroentangling was conducted off-line rather than in-line. The bicomponent fibers are prepared from 50% by weight of a linear low density polyethylene and 50% by weight of isotactic polypropylene, in a side by side configuration. In addition, the nonwoven web contains isotactic polypropylene fibers which are produced in the same process and are blended in with the bicomponent fibers. The nonwoven web has about 25% propylene monocomponent fibers and about 75% bicomponent fibers. The nonwoven web has a basis weight of about 110 grams per square meter (gsm) and a bulk density of about 0.1033 g/cm$^3$. As a control a portion of the resulting nonwoven web was not hydroentangled. Another portion of the nonwoven web was hydroentangled with 2 injectors at a pressure of 700 psi with a single pass through the injectors. Hydroentangling was performed at a line speed of about 600 feet per minute. Air permeability and efficiency were determined using the test procedures described above and are plotted on FIG. 5.

A second sample of the control and the hydroentangled filter material were tested under ASHRAE 52.2 1999 test described above. The control had a MERV 11 rating with a 0.39 inches of water pressure drop while the hydroentangled filter media had a MERV 13 rating with a 0.40 inches of water pressure drop.

As can be seen in Examples 1-3, hydroentangling the nonwoven webs, which results in the partial splitting of the bicomponent fibers, improves the efficiency of the resulting nonwoven web when used as a filter media, without any significant lost in the permeability of the nonwoven web as compared to the control. In addition, the MERV rating is increased without any significant increase in the pressure drop across the filter. As a result, the nonwoven web of the present invention is very effective as a filtration media and more effective as a filtration media than the control.

EXAMPLE 4

A low loft bicomponent fiber spunbond nonwoven web was prepared in accordance with FIG. 3, except the hydroentangling was conducted off-line rather than in-line. The bicomponent fibers are prepared from 50% by weight of a linear low density polyethylene and 50% by weight of isotactic polypropylene, in a side by side configuration and have a generally round configuration. The nonwoven web has a basis weight of about 110 grams per square meter (gsm) and a bulk density of about 0.112 g/cm$^3$. As a control a portion of the resulting nonwoven web was not hydroentangled. Another portion of the nonwoven web was hydroentangled with 2 injectors at a pressure of 700 psi with a single pass through the injectors. Hydroentangling was performed at a line speed of about 600 feet per minute.

Figure 6:
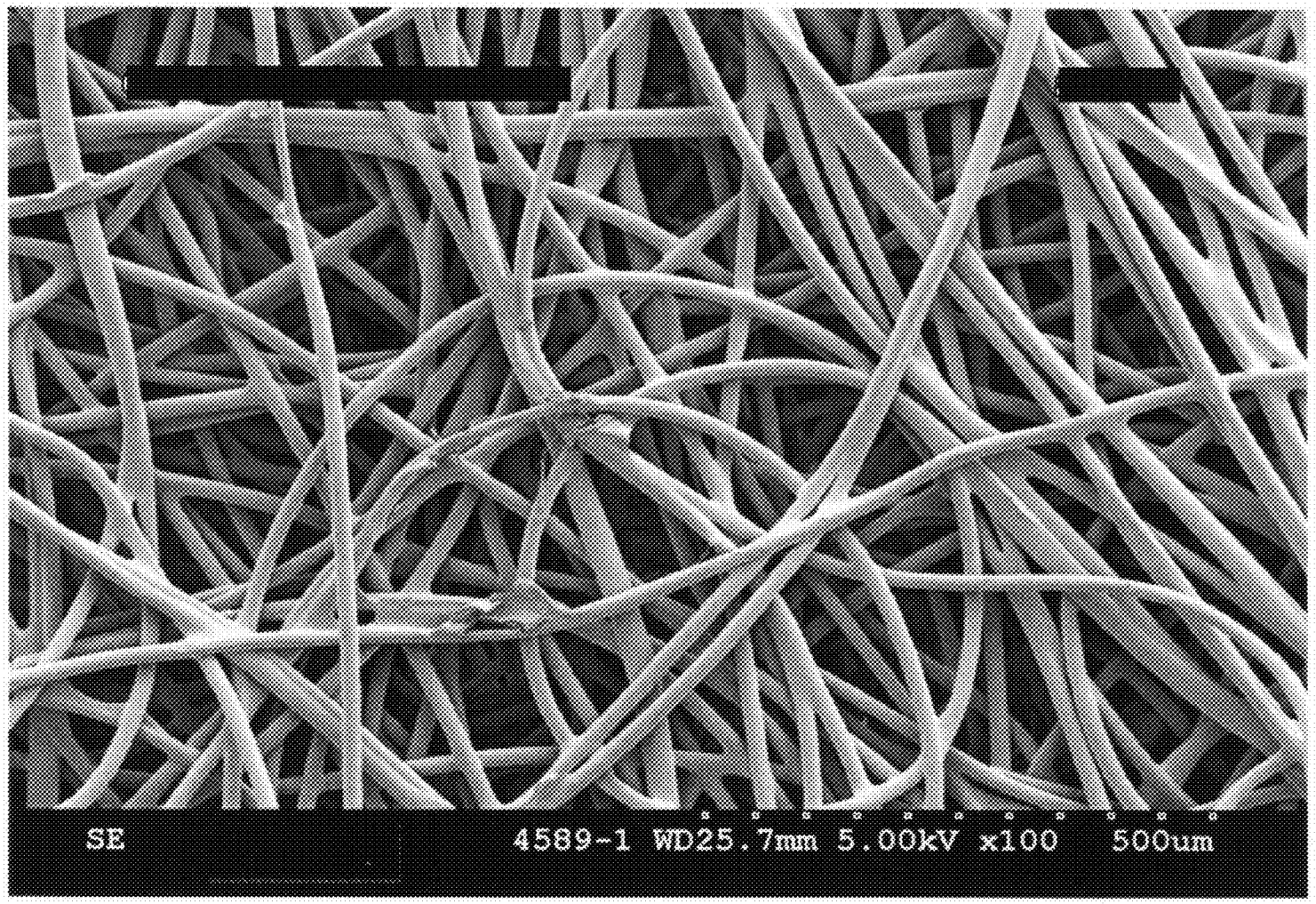
FIGS. 6 and 6A are micrographs of the materials produced in Example 4.
Figure 6A:
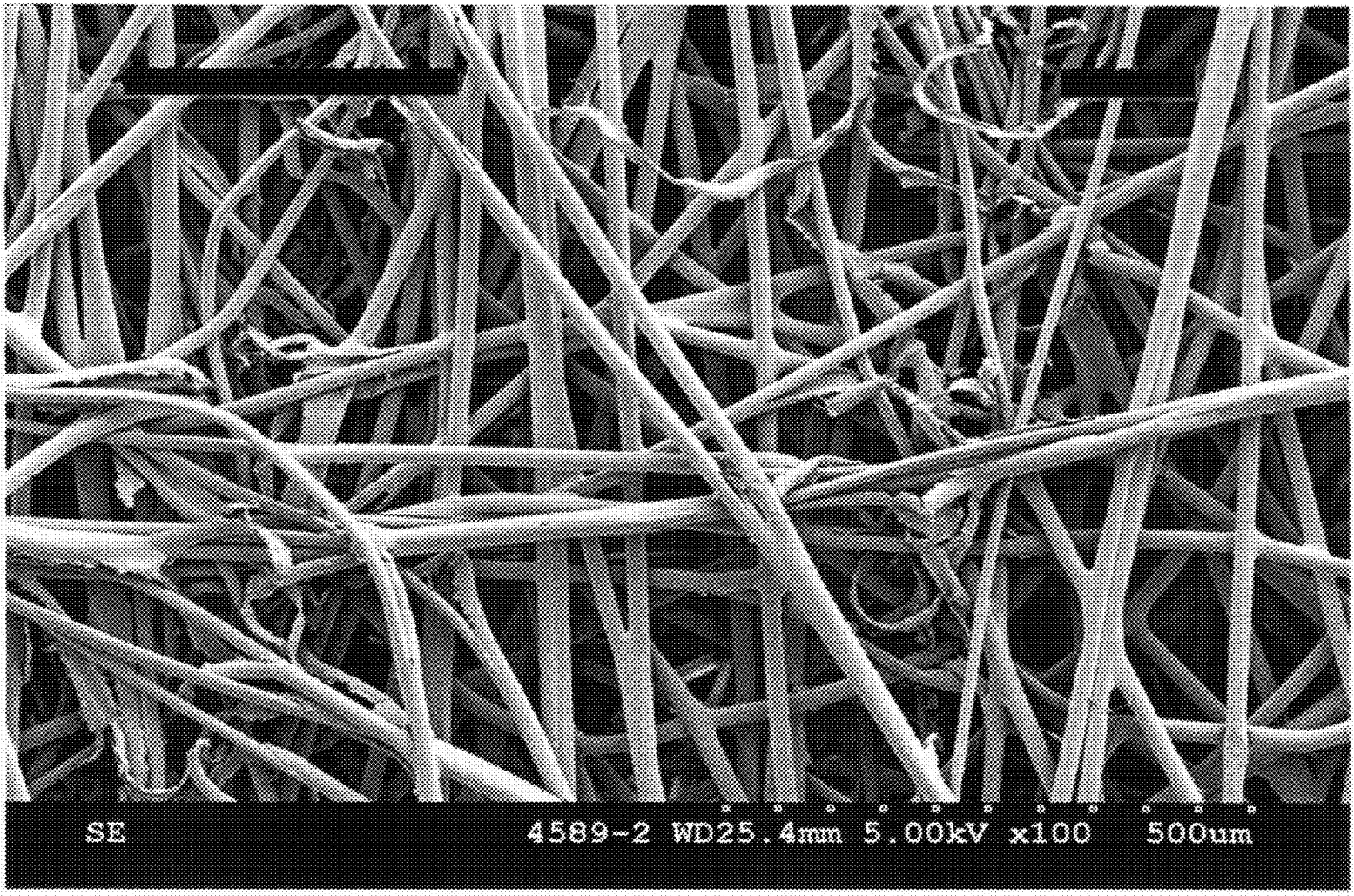

FIG. 6 shows a micrograph of the control nonwoven web without hydroentangling and FIG. 6A shows a micrograph of the hydroentangled nonwoven web. As can be readily seen, the hydroentangled nonwoven web contains split and non-split fibers while the control does no splitting of the fibers. In addition, interfiber bonds between the fibers of the nonwoven web can also be seen.

Air permeability and efficiency were determined using the test procedures described above. The control had a filtration efficiency 58% and an air permeability of 202 ft$^3$/min. The hydroentangled nonwoven web had a filtration efficiency of 80% and an air permeability of 186 ft$^3$/min.

A second sample of the control and the hydroentangled filter material were tested under ASHRAE 52.2 1999 test described above. The control had a MERV 11 rating with a 0.37 inches of water pressure drop while the hydroentangled filter media had a MERV 13 rating with a 0.40 inches of water pressure drop.

EXAMPLE 5

A laminate of two nonwoven webs was formed. The first is a low loft bicomponent fiber spunbond nonwoven web was prepared in accordance with FIG. 3, without the hydroentangling. The bicomponent fibers are prepared from 50% by weight of a linear low density polyethylene and 50% by weight of isotactic polypropylene, in a side by side configuration and have a generally round configuration. The nonwoven web has a basis weight of about 110 grams per square meter (gsm) and a bulk density of about 0.112 g/cm$^3$. The second is high loft bicomponent spunbond nonwoven web, prepared in a similar manner to the process of FIG. 3, without the hydroentangling. The second nonwoven also contains bicomponent fibers are prepared from 50% by weight of a linear low density polyethylene and 50% by weight of isotactic polypropylene, in a side by side configuration and have a generally round configuration. The nonwoven web has a basis weight of about 56 grams per square meter (gsm) and a bulk density of about 0.0295 g/cm$^3$.

The first and second nonwoven webs unwound separate rolls and laid upon one another such that the low loft first nonwoven web is placed on top of the high loft nonwoven web. The two nonwoven webs were subjected a hydroentangling treatment such that the water jets impinged on the low-loft layer. The hydroentangling was accomplished with 2 injectors at a pressure of 1000 psi with a single pass through the injectors. Hydroentangling was performed at a line speed of about 60 feet per minute.

The efficiency and air permeability test of the nonwoven web was performed in accordance with the above cited test procedures. The hydroentangled nonwoven web had a filtration efficiency of 82% and an air permeability of 165 ft$^3$/min.

EXAMPLE 6

A laminate of webs was formed having two layers of spunbond and a layer of meltblown between the spunbond layers. The spunbond layers were prepared in accordance with FIG. 3, without the hydroentangling. The bicomponent fibers are prepared from 50% by weight of a linear low density polyethylene and 50% by weight of isotactic polypropylene, in a side by side configuration and have a generally round configuration. A layer of polypropylene meltblown was laid down on one of the spunbond layers and the overall nonwoven web has a basis weight of about 115 grams per square meter (gsm) and a bulk density of about 0.0825 g/cm$^3$. The layers of the laminate were thermally bonded together.

As a control a portion of the resulting nonwoven web laminate was not hydroentangled. Another portion of the nonwoven web was hydroentangled with 2 injectors at a pressure of 700 psi with a single pass through the injectors. Hydroentangling was performed at a line speed of about 300 feet per minute. The efficiency and air permeability test of the nonwoven web was performed in accordance with the above cited test procedures. The control had a filtration efficiency of 75% and an air permeability of 73 ft$^3$/min. The hydroentangled nonwoven web laminate had a filtration efficiency of 96% and an air permeability of 75 ft$^3$/min.

A second sample of the control and the hydroentangled filter material were tested under ASHRAE 52.2 1999 test described above. The control had a MERV 13 rating with a 0.37 inches of water pressure drop while the hydroentangled filter media had a MERV 16 rating with a 0.31 inches of water pressure drop.

Again it can be seen that the hydroentangling of the nonwoven web laminate improves the overall efficiency without a significant increase in the air permeability or pressure drop across the filtration media.

As can be seen in the forgoing Examples, the nonwoven web and nonwoven web laminates of the present invention, when used as a filter media, has improved filtration efficiency without sacrificing the permeability of the filtration media as compared to filter media without the partially split multicomponent fibers.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A nonwoven web comprising multicomponent fibers, the multicomponent fibers having a longitudinal length, each multicomponent fiber having at least a first component and at least a second component, wherein the first component has a lower melting point or glass transition temperature than the second component, a portion of the multicomponent fibers are partially split, where at least one component of the multicomponent fiber has separated from the remaining components of the multicomponent fiber along a first section of the longitudinal length of the multicomponent fibers, along a second section of the longitudinal length of the multicomponent fibers the components of the multicomponent fibers remain together as a unitary fiber structure, and wherein part of the second section of the multicomponent fibers is non-compressively bonded to part of a second section of an adjacent multicomponent fiber, wherein the multicomponent fibers of the nonwoven web have a low degree of splitting.

2. The nonwoven web according to claim 1, wherein a second portion of the multicomponent fibers are unsplit.

3. The nonwoven web according to claim 1, wherein the nonwoven web is first thermally bonded and then hydroentangled, whereby the hydroentangling of the nonwoven web results in the first portion of multicomponent fibers becoming partially split.

4. The nonwoven web according to claim 3, wherein the multicomponent fibers comprise spunbond fibers, staple fibers or a mixture thereof.

5. The nonwoven web according to claim 3, wherein the multicomponent fibers comprise bicomponent fibers.

6. The nonwoven web according to claim 5, wherein the bicomponent fibers have a side-by-side configuration.

7. The nonwoven web according to claim 5, wherein the bicomponent fibers comprise continuous fibers.

8. The nonwoven web according to claim 3, wherein the portion of the second section of the multicomponent fibers are bonded to an adjacent multicomponent fiber by thru-air bonding.

9. The nonwoven web according to claim 1, wherein the components of the multicomponent fibers are each a thermoplastic polymer selected from the group consisting of polyesters, polyolefins, polyamides, polyacrylates, polymethacrylates, polylactic acid, polyhydroxy alkanates and combinations thereof.

10. The nonwoven web according to claim 5, wherein a first component of the bicomponent fibers is a polyethylene and the second component is a polypropylene.

11. The nonwoven web according to claim 10, wherein the bicomponent fibers comprise 90-10% by weight polyethylene and 10-90% by weight polypropylene.

12. The nonwoven web according to claim 11, wherein the bicomponent fibers comprise 60-40% by weight polyethylene and 40-60% by weight polypropylene.

13. The nonwoven web according to claim 1, wherein the multicomponent fibers are at least partially crimped.

14. The nonwoven web according to claim 1, wherein the multicomponent fibers comprise essentially round fibers.

15. The nonwoven web according to claim 1, wherein the multicomponent fibers comprise shaped fibers.

16. The nonwoven web according to claim 1, wherein the nonwoven web is electret treated.

17. A laminated nonwoven material comprising the nonwoven web according to claim 1 laminated to one or more nonwoven webs selected from the group consisting of spunbond nonwoven webs, meltblown nonwoven webs, bonded carded webs, coform nonwoven webs, and/or hydroentangled nonwoven webs.

18. A filter media comprising a nonwoven web, the nonwoven web comprising multicomponent fibers, the multicomponent fibers having a longitudinal length, each multicomponent fiber having at least a first component and at least a second component, wherein the first component has a lower melting point or glass transition temperature than the second component, a portion of the multicomponent fibers are partially split, where at least one component of the multicomponent fiber has separated from the remaining components of the multicomponent fiber along a first section of the longitudinal length of the multicomponent fibers, along a second section of the longitudinal length of the multicomponent fibers the components of the multicomponent fibers remain together as a unitary fiber structure, and wherein part of the second section of the multicomponent fibers is non-compressively bonded to part of a second section of an adjacent multicomponent fiber, wherein the multicomponent fibers of the nonwoven web have a low degree of splitting.

19. The filter media according to claim 18, wherein a second portion of the multicomponent fibers are unsplit.

20. The filter media according to claim 18, wherein the nonwoven web is first thermally bonded and then hydroentangled, whereby the hydroentangling of the nonwoven web results in the first portion of multicomponent fibers becoming partially split.

21. The filter media according to claim 20, wherein the multicomponent fibers comprise spunbond fibers, staple fibers or a mixture thereof.

22. The filter media according to claim 20, wherein the multicomponent fibers comprise bicomponent fibers.

23. The filter media according to claim 22, wherein the bicomponent fibers have a side-by-side configuration.

24. The filter media according to claim 22, wherein the bicomponent fibers comprise continuous fibers.

25. The filter media according to claim 20, wherein the portion of the second section of the multicomponent fibers are bonded to an adjacent multicomponent fiber by thru-air bonding.

26. The filter media according to claim 18, wherein the components of the bicomponent fibers are each a thermoplastic polymer selected from the group consisting of polyesters, polyolefins, polyamides, polyacrylates, polymethacrylates, polylactic acid, polyhydroxy alkanates and combinations thereof.

27. The filter media according to claim 22, wherein a first component of the bicomponent fibers is a polyethylene and the second component is a polypropylene.

28. The filter media according to claim 27, wherein the bicomponent fibers comprise 90-10% by weight polyethylene and 10-90% by weight polypropylene.

29. The filter media according to claim 28, wherein the bicomponent fibers comprise 60-40% by weight polyethylene and 40-60% by weight polypropylene.

30. The filter media according to claim 18, wherein the multicomponent fibers are at least partially crimped.

31. The filter media according to claim 18, wherein the nonwoven web is electret treated.

32. The filter media according to claim 18, wherein the multicomponent fibers comprise essentially round fibers.

33. The filter media according to claim 18, wherein the multicomponent fibers comprise shaped fibers.

34. The filter media according to claim 18, further comprising as least one additional layer laminated to the nonwoven web, the additional layer comprising one or more nonwoven webs selected from the group consisting of spunbond nonwoven webs, meltblown nonwoven webs, bonded carded webs, coform nonwoven webs, and/or hydroentangled nonwoven webs.

35. The filter media according to claim 18, wherein the degree of splitting is between about 0.1% and about 25% based on the total length of all fibers in a given test area.

36. The nonwoven web according to claim 1, wherein the degree of splitting is between about 0.1% and about 25% based on the total length of all fibers in a given test area.

37. The nonwoven web according to claim 36, wherein the degree of splitting is between about 0.5% and about 15% based on the total length of all fibers in a given test area.

* * * * *